United States Patent [19]

Woodrow

[11] 4,257,716

[45] Mar. 24, 1981

[54] ROLL-FORMED METAL EAVESTROUGHING WITH PLASTIC FITTINGS

[75] Inventor: David G. Woodrow, Dundas, Canada

[73] Assignee: GSW Limited/GSW Limitee, Toronto, Canada

[21] Appl. No.: 9,751

[22] Filed: Feb. 5, 1979

[51] Int. Cl.[3] ..... E02B 5/00

[52] U.S. Cl. ..... 405/118; 52/11; 405/121

[58] Field of Search ..... 405/118, 119, 120–123; 52/11–15

[56] References Cited

U.S. PATENT DOCUMENTS

| | | | |
|---|---|---|---|
| 3,417,570 | 12/1968 | Pegan et al. | 52/16 X |
| 4,142,370 | 3/1979 | Giordano | 52/11 X |

FOREIGN PATENT DOCUMENTS

| | | | |
|---|---|---|---|
| 993555 | 5/1965 | United Kingdom | 52/11 |
| 1065596 | 4/1967 | United Kingdom | 52/11 |
| 1090291 | 11/1967 | United Kingdom | 52/11 |

*Primary Examiner*—Dennis L. Taylor

[57] ABSTRACT

An eavestroughing system comprises a roll-formed sheet metal eavestrough in combination with plastic injection molded fitting therefor. The eavestrough has a compactly overturned longitudinally extending edge portion along each sidewall of a thickness substantially greater than the thickness of the metal in the trough. The support fitting is formed of semi-rigid plastic and has two spaced-apart clip portions adapted to receive the trough edge portions. The fitting has a body portion with an internal surface approximating the external shape of the trough to encompass same when the trough is clipped into and supported by the plastic fittings.

7 Claims, 7 Drawing Figures

ROLL-FORMED METAL EAVESTROUGHING WITH PLASTIC FITTINGS

FIELD OF THE INVENTION

This invention relates to eavestroughing systems in particular the combination of a roll-formed sheet metal eavestrough with plastic injection molded fittings.

BACKGROUND OF THE INVENTION

It is generally accepted in the eavestroughing trade that metal fittings are used with metal eavestroughing and plastic fittings are used with plastic eavestroughing. Several approaches have been taken in the past to simplify the installation of metal eavestroughing on homes, such as in the use of cast brackets which are secured to the eaves to retain the metal trough in position. However, casting of brackets is relatively expensive. The standard spike and furrel is, therefore, commonly used in attaching metal eavestrough to an eave. In the line of plastic eavestroughing several advances have been made in providing fittings to join plastic trough and secure it to an eave. Such plastic troughing and fittings may be of the type disclosed in U.S. Pat. No. 3,355,895. There are several drawbacks, however, in using plastic eavestroughing, in that it readily cracks in the colder climates such as when a ladder is placed against the troughing. The thermal expansion of plastic troughing is substantially greater than metal and is in the range of at least ten times greater; therefore, special fittings have to be devised to accommodate this substantial variation in the length of the trough during seasonal changes in climate. The complex structures that are, therefore, devised may be of the type shown in the above-referred to U.S. patent to accommodate this thermal expansion in plastic fittings. The further problem encountered with respect to plastic troughing is that it is usually extruded, thereby requiring year-round production of the trough in order to accumulate sufficient inventory to meet the demands of spring, summer and fall construction trades. With the best of extruders used, it is appreciated in the art that only about 750 feet of trough may be extruded in an hour. Therefore, to avoid year-round production, more extruders may be purchased; however, this proves to be extremely costly, since one extruder may be in the range of $150,000 to $200,000 capital investment. As a result, the manufacture of plastic troughing requires a very high capital investment which makes it very difficult to maintain profitable margins in the industry with the wide fluctuation in the cost of plastic resin.

A further drawback that has been encountered in the use of plastic eavestroughing systems is that the trough cannot be formed of plastic which can maintain a dark colour over extended periods of time. Most plastic troughing is, therefore, of the lighter pastel colours which limits the market to which the troughing may be directed. It is now desired by the consumer that darker eavestroughing be provided to match various darker roof colours. With the darker colours of plastic eavestroughing, the problem encountered is that the ultraviolet radiation tends to bleach the trough over period of time, so that its life is limited.

I have discovered that the use of a roll-formed sheet metal eavestrough with plastic injection molded fittings, therefore, provides substantial advantages. In using the metal eavestrough with plastic fittings, the thermal expansion/contraction of the metal is substantially less than in plastic, as already mentioned. The use of metal eavestroughing is an all-weather type of installation, in that during the winter time, no concern need be given to cracking induced by blows, such as placing a ladder against the house or due to wide variations in expansion and contraction of the metal. The steel may be zinc coated, primed and covered with a topcoat of paint to give any desired colour where the life expectancy of such coats is roughly twenty years. The steel is easier to install in that it has a smoother sidewall portion and due to its particular construction is more flexible to permit snapping of the troughing into the fittings. The paint coat on the steel readily resists ultra-violet degredation to thereby meet the demands of the marketplace with respect to darker coloured material. As mentioned, one of the problems with former metal systems is that it was difficult to form the fittings out of metal; however, in adapting the use of plastic fittings, they are readily injection molded. In roll-forming the eavestroughing, it is appreciated that such units require substantially less capital investment and roll-forming speeds of approximately 9,000 feet per hour can be achieved which is roughly 12 times the rate of production with respect to extruding plastic eavestroughing. As a result, the fluctuating demands of the marketplace with respect to eavestroughing can be met on a more short-term basis resulting in substantially less carry of inventory throughout the year.

It is, therefore, an object of the invention to provide an eavestroughing system which is far superior to known metal eavestroughing systems and known plastic eavestroughing systems.

It is a feature of the invention to accomplish such object in the combined use of a roll-formed sheet metal eavestrough with plastic injection molded fittings or supports therefor.

The above-identified advantages flow from this feature of the invention.

SUMMARY OF THE INVENTION

The eavestroughing system, according to this invention, comprises in combination a roll-formed sheet metal eavestroughing and plastic injection molded fitting supports therefor. The eavestrough has compactly overturned, longitudinally extending edge portions of a thickness substantially greater than the thickness of the metal. The fitting is formed of semi-rigid plastic and has two spaced-apart clip portions to receive the trough edge portions. The fitting has a body portion with an internal surface approximately the external shape of the trough to encompass same when the trough is clipped into and supported by the plastic support.

The roll-formed sheet metal eavestrough, having the overturned upper edges, provides an unexpected resiliency which readily permits snapping of the metal trough into the plastic support and recovers to snug up the relationship of the trough relative to the fitting to provide a secure supporting and affixing of the trough to the eaves.

DESCRIPTION OF THE DRAWINGS

Preferred embodiments of the invention are as shown in the drawings wherein.

DETAILED DESCRIPTION OF THE PREFERRED EMBODIMENTS OF THE INVENTION

Figures 1, 5:
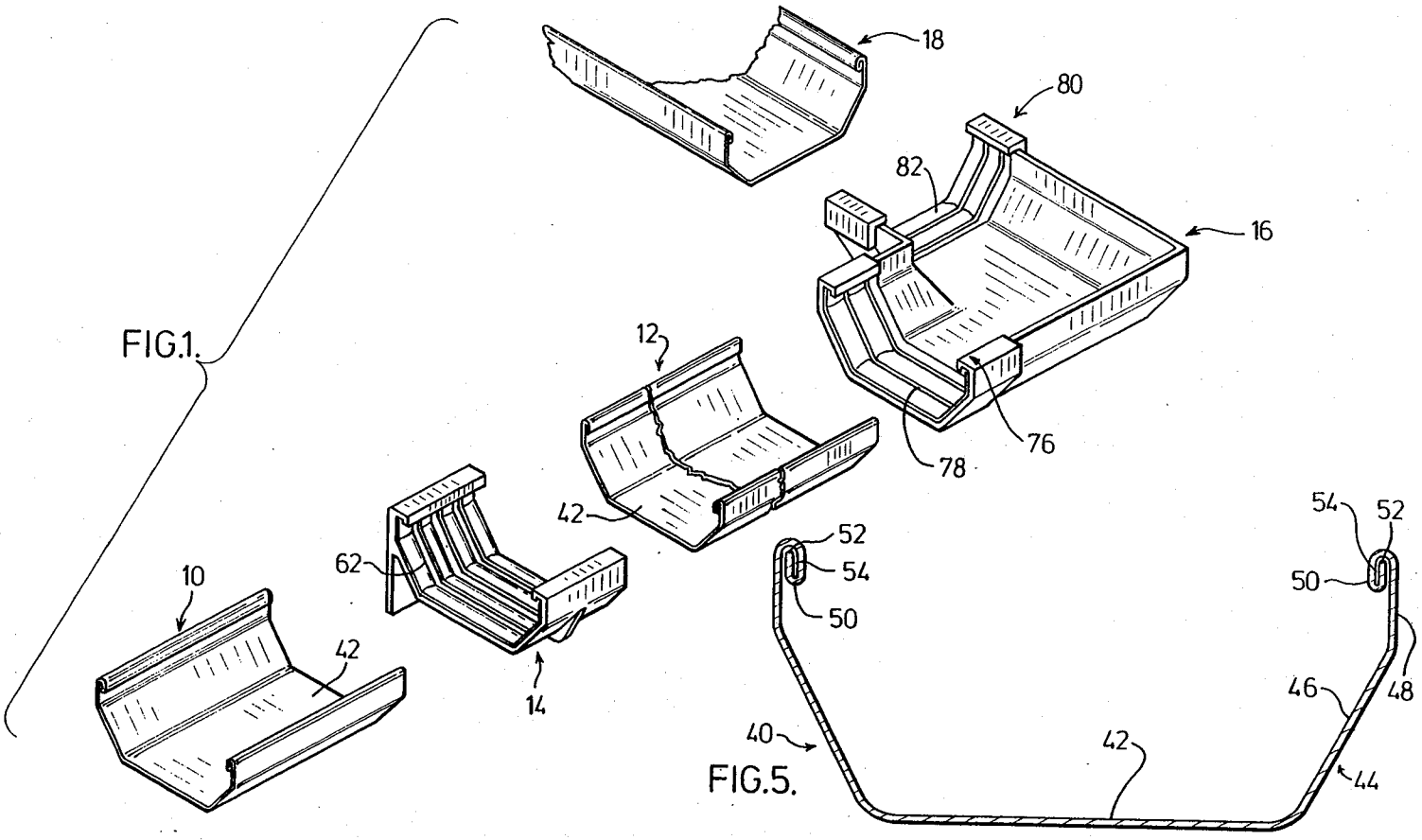
FIG. 1 is an exploded view of the roll-formed sheet metal eavestrough and plastic fittings therefor.
FIG. 5, which appears on the sheet with FIG. 1, is a section through a preferred shape for the roll-formed metal eavestrough.

FIG. 1 shows the two roll-formed sheet metal eavestrough sections 10 and 12 about to be clipped into a plastic injection molded joining member 14. To complement the system, a mitre joining member 16 is shown for traversing the corner of a house where the ends of eavestrough section 12 and section 18 are inserted into the clip portions of mitre 16.

Figure 2:
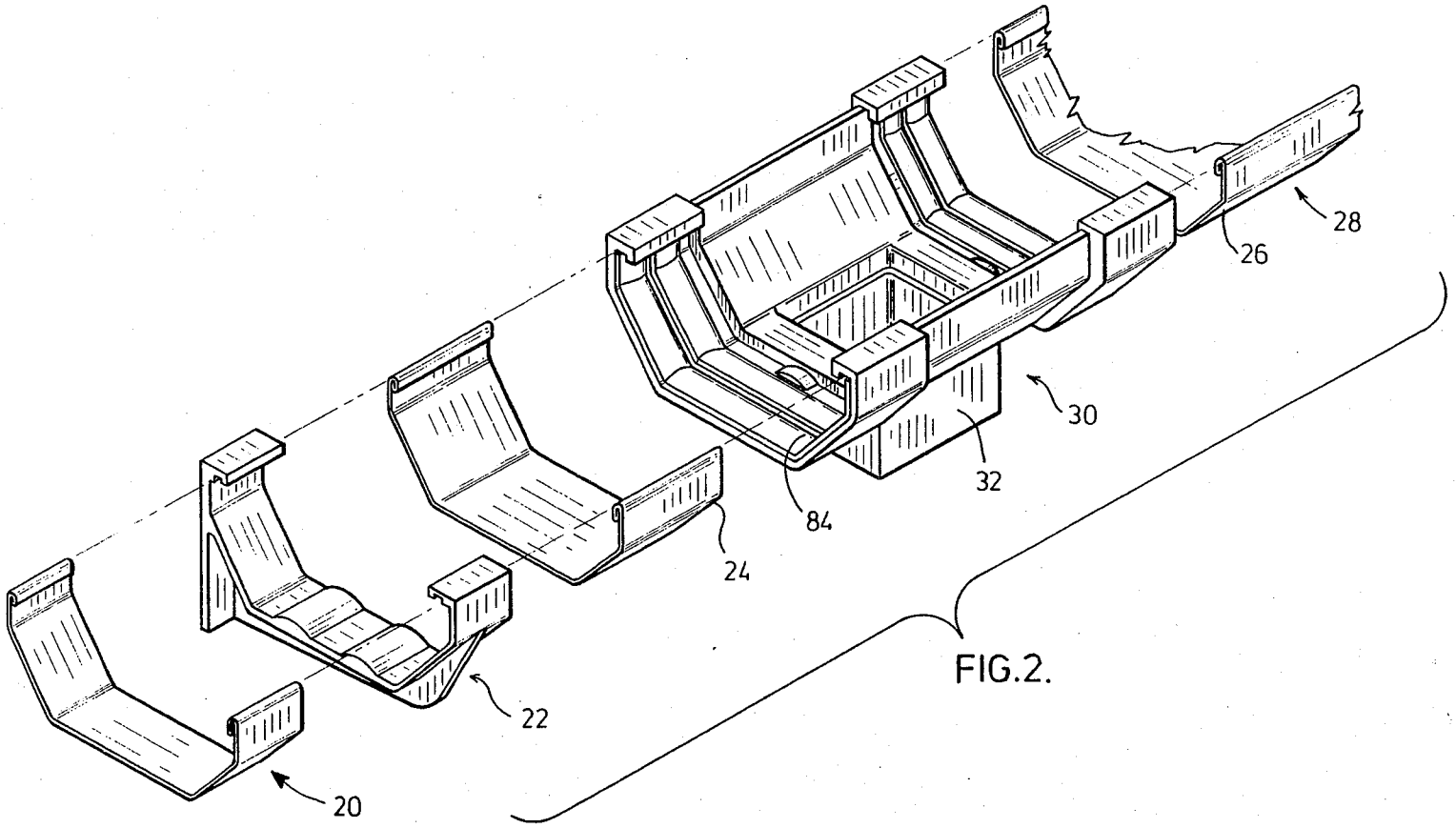
FIG. 2 is an exploded view of the roll-formed metal eavestrough with other fittings therefor.

FIG. 2 shows further injection molded plastic fittings for the eavestroughing system where an eavestrough section 20 is held by support 22. The end 24 of eavestrough section 20 and end 26 of eavestrough section 28 are clipped to a further plastic fitting 30 which includes a downspout 32.

Figure 3:
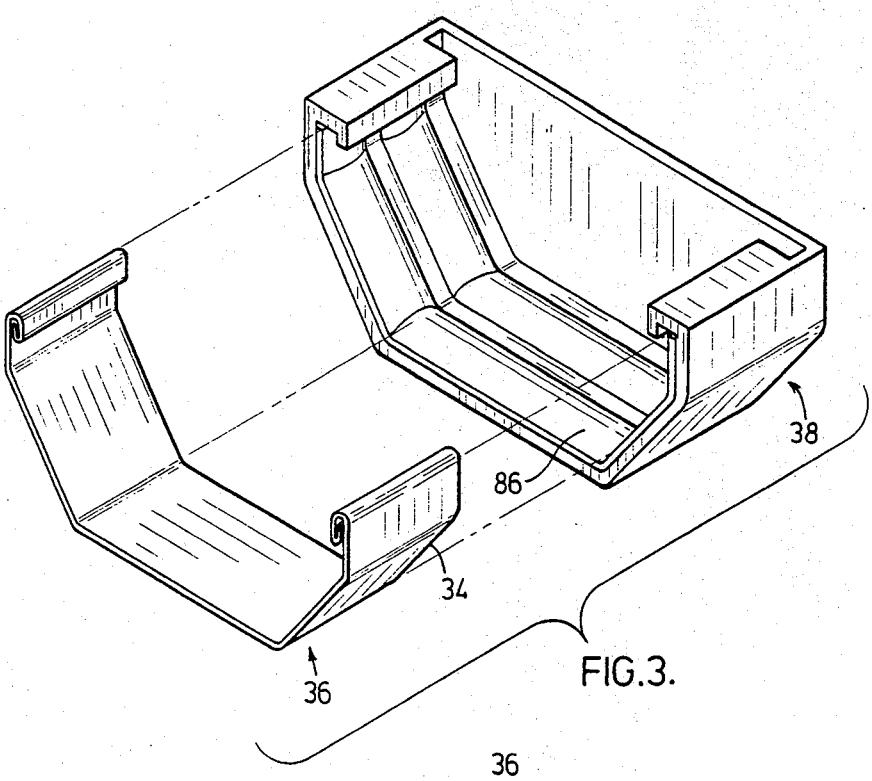
FIG. 3 is an exploded view of a further plastic fitting for the metal eavestrough.
Figure 4:
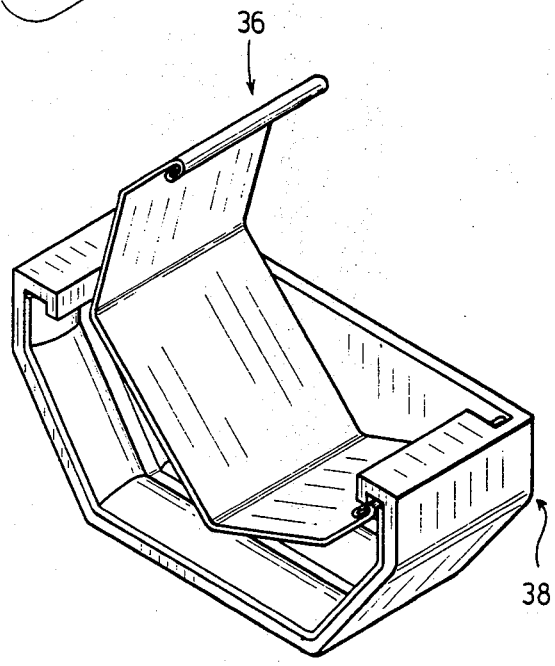
FIG. 4 shows the manner in which the metal eavestrough is inserted in the plastic fitting of FIG. 3.

A further type of plastic fitting for use with the eavestrough is shown in FIG. 3, where the end 34 of eavestrough section 36 is inserted into a blind end cap 38. The manner in which the eavestrough section 36 is inserted into the blind end cap 38 is shown in FIG. 4.

A preferred embodiment for the cross-sectional shape of the roll-formed eavestrough is shown in FIG. 5 where the eavestrough section 40 has a base portion 42 to each side of which is a generally upwardly extending sidewall 44. The sidewall is compound of an outwardly, upwardly extending portion 46 and an essentially vertically extending portion 48 which merges into overturned portion 50. The overturned portion 50 is the upper extremity of the vertical portion 48, folded twice onto itself such that the raw edge 52 is tucked up under the overturned portion 50. Gaps 54 are formed in the overturned portion which are of minimal dimension; however, are such that the thickness of the overturned portion 50 may be approximately four to five times the thickness of the metal in the trough section 40.

The roll-formed trough may be of various thicknesses preferably of 30 or 28 gauge. As a result, the overturned portion 50, when turned over in the manner shown, has a thickness of approximately 70 thousands of an inch due to the gaps provided.

The plastic injection molded fittings may be formed from various well-known, readily available plastics, such as polyvinylchloride which withstands the severity of winters and hot summers and is not readily cracked in the colder climates. Further, colours may be admixed with the polyvinylchloride to give various colours which contrast with or match the exterior colour of the troughing sections. The polyvinylchloride is semi-rigid to permit a degree of flexibility in the support or fitting portions to permit clipping or snapping of the trough into the support members. The fittings are injection molded to thereby accomplish the various configurations needed for the fittings as shown in FIGS. 1 through 4 of the drawings, such as the butt joiner 14, the mitre 16, the downspout 30 and the end cap 38.

The sheet metal may be prepainted prior to roll-forming the troughing; for example, the strips which are subsequently rolled to form the trough may be formed by slitting a coil of prepainted sheet. Therefore, there is the advantage of tucking the raw edge 52 underneath the overturned portion 50 to protect it from the elements. The troughing may be painted in any desired colour where preferably it is zinc coated, primed and then followed with a topcoat which may be baked to substantially prolong the trough's finish life. It is desired to provide a trough finish which will last approximately twenty years.

Figure 6:
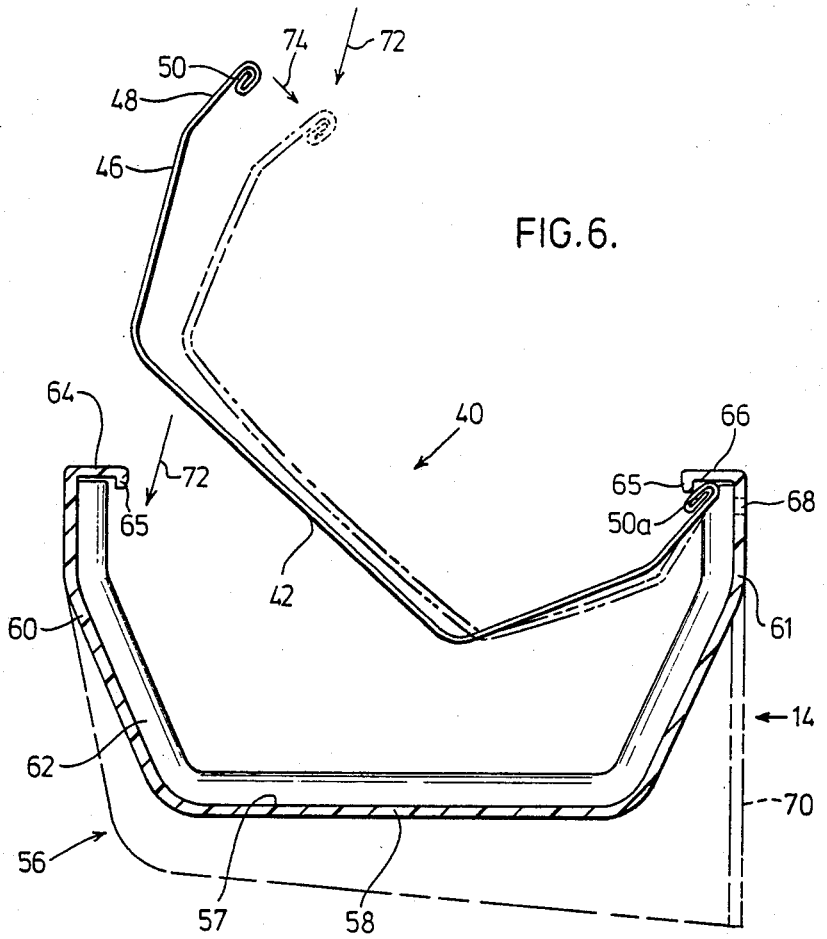
FIG. 6 shows the roll-formed metal eavestrough of FIG. 5 about to be inserted in a plastic fitting.

Turning to FIG. 6, the butt joiner fitting 14 is shown. The joiner 14 comprises a body portion generally designated 56, having a base portion 58 and generally upwardly extending sidewalls 60 of shape approximating the exterior shape of the eavestroughing section 40. Affixed to the inside surface of the body portion 56 is a compressible or resilient sealing liner 62 which preferably is secured to the body portion by the use of an adhesive. The dimensioning of the internal surface 57 is such that, with the liner in position, the troughing 40 can be snapped into the joiner 14. The upwardly extending leg portions 60 and 61 terminate in the clip portions 64 and 66.

The leg portion 61 has at its upper end an aperture 68 which facilitates or permits fastening of the joiner 14 to the eaves or facia board. Molded with the body portion is a downwardly depending flange or face shown in dot as 70 to secure and prevent twisting of the joiner when affixed to the facia board. It is understood that the other fittings include such flange portions with apertures to permit affixing to the eave.

The liner thickness is selected such that it may be compressed a certain degree upon forcing an end of the trough section 40 into the joiner 14. It has been found that, with this design for the trough, it can be flexed about its compound sidewalls to cause in base portion 42 an innerward bowing to facilitate positioning of the overturned portions 52 beneath the downwardly depending lugs 65 of the clips. This flexing in the trough is more readily accomplished than with the prior plastic extruded sections. The reason for this is that a very thin wall may be used for the trough and then the needed thickened portion at the top provided by the overturned section. On the other hand, with a plastic extrusion, a much thicker wall is required to impart the desired structural characteristics needed, thereby detracting from the flexibility of the plastic extrusions. As a result, substantial forces are needed to place the plastic troughing section into the joiners and other injection molded fittings. As can be appreciated, in cold weather the plastic is much stiffer and in some instances, it is practically impossible to accomplish an installation in the winter time. Whereas with the metal plastic combination for the eavestroughing system of this invention, the metal is, of course, readily flexed in the winter time to facilitate installation.

Figure 7:
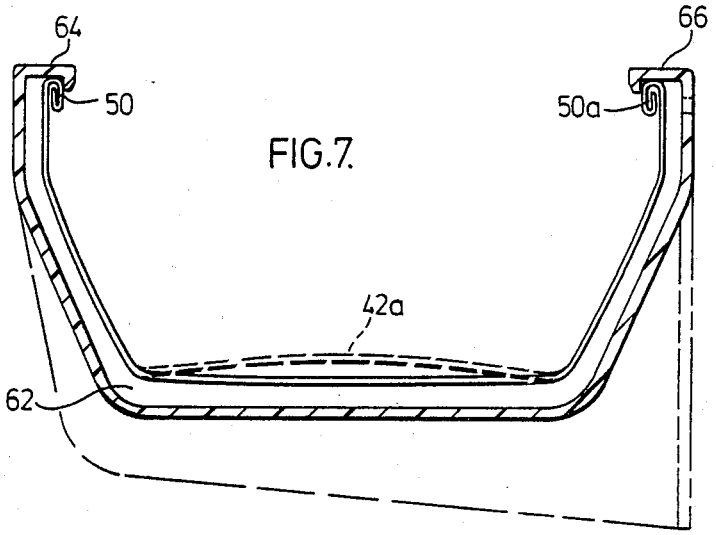
FIG. 7 shows the assembled combination of FIG. 6.

The preferred manner of inserting the trough into the joiner 14 is to place its rear overturned edge **50*a* beneath the clip 66 and then with a downward component of force in the direction of arrows 72 and an inward movement of force in the direction of arrow 74, the trough is pushed beneath the other clip 64 by depressing the foam or compressible liner 62. The bowing of the base portion 42 is shown in dot 42*a* in FIG. 7. This permits the overturned portions 50 to be inserted beneath the clips 64 and 66**. When the overturned portion 50 is beneath the clips, the base portion 42 attempts to resume its original planar position to the extent shown in FIG. 7, thereby pushing its base down against the compressible liner 62 so as to achieve a substantially contiguous contact of linear with the exterior of the troughing around its base and upwardly extending sidewalls to achieve a seal. This is necessary, as shown in FIG. 1, where the joiner 14 is used to butt join trough sections 10 and 12 such that a sealing portion of the compressible liner 62 emcompasses or contacts at least the base portions 42 of each trough end portion to form a proper joint, so that there is no leakage in this area.

The various plastic fittings which entail joining one section of trough to the other, incorporates a compressible liner such as 62 in joiner 14. For example, in the mitre 16, the clip portions generally designated as 76 include therebeneath compressible liner 78, similarly clip 80 has compressible liner 82. Also, the downspout 30 has compressible liner 84 and end cap 38 has compressible liner 86. All of these are designed to function in the manner shown in FIGS. 6 and 7 to provide a waterproof joining of the end of the trough section to the joiner.

It can be appreciated that, in using a roll-formed eavestrough section, it is possible to use portable roll formers so that on-site forming of the trough section may be accomplished. As a result, sufficiently large strips may be carried to the site to thereby form a trough section which would extend the entire length of the house or building to which it is to be affixed. Roll-forming of the trough provides a reasonably precise control on the profile so that a superior and more consistent joining may be achieved with the injection molded plastic fittings.

The turned-over edge of the eavestrough provides a strong section such that ladders and the like may be leaned against the trough and not deform the trough sidewalls. Further, such overturned edge in having the gaps formed therein prevents kinking of the trough more readily than would be the case with other types of metal troughing.

Other portions of the eavestrough assembly may be roll-formed, such as the down pipe which is connected to the spout 32 of fitting 30. Again, in roll-forming this box section, one achieves the high rates of production and durability as compared to the plastic extruded sections.

It is apparent that this eavestroughing system is readily installed by the householder, that is a do-it-yourself installation. However, new house construction can benefit from this type of eavestrough system because on most new homes plain galvenized steel troughing is installed. A plain galvenized steel troughing, as shown in FIG. 5, requires substantially less metal than the prior types of troughing. This system requires no soldering, therefore, avoids potential injuries to the installer and in avoiding the soldering step provides for faster installation. No compounding is required in the joints that contraction/expansion of troughing does not cause leaks, therefore on new homes installation of this system frees the installer from callback problems, providing the troughing is installed properly with the plastic fittings.

It can, therefore, be realized that this combination of roll-formed sheet metal eavestrough and plastic injection molded support fittings therefor to secure the eavestrough to the building walls or eaves, provides a system which gives the unexpected improved joining capabilities and water tightness, together with all of the advantages which flow from the roll-forming of the troughing and the injection molding of the plastic parts.

Although various embodiments of the invention have been described herein in detail, it will be understood by those skilled in the art, that variations may be made thereto without departing from the spirit of the invention or the scope of the appended claims.

The embodiments of the invention in which an exclusive property or privilege is claimed are defined as follows:

1. In combination a roll-formed sheet metal eavestrough and a plastic injection molded support fitting therefor, said eavestrough having compactly overturned longitudinally extending edge portions of a thickness substantially greater than the thickness of the metal, said fitting being formed of semi-rigid plastic and having two spaced-apart clip portions to receive said through edge portions as they are snap-fitted into said clips, said fitting having a body portion with an internal surface approximating the external shape of said trough to encompass same with said trough clipped in and supported by said fitting.

2. In the combination of claim 1 said eavestrough having a semi-circular cross-section.

3. In the combination of claim 1 said eavestrough having a base portion with integral generally upwardly extending sidewalls.

4. In the combination of claim 3 said edge portion being overturned twice to place the raw edge within the overturned portion, the thickness of said overturned portion being substantially greater than the thickness of the metal by virtue of gaps between sections of the overturned portion.

5. In the combination of claim 4 said sidewalls being compound of a first outwardly and upwardly extending portion and a second essentially vertical portion.

6. In the combination of claim 1 said eavestrough having a base portion with integral generally upwardly extending sidewalls, said internal surface of the fitting body portion having a compressible sealant liner, said liner contacting the exterior of said trough clipped in said fitting as said liner is compressed by said trough, the arrangement being such that a sealed butt joint of trough sections is formed by each trough section end compressing a portion of said liner.

7. In the combination of claim 1 said metal eavestrough being prepainted.

* * * * *